US008333509B2

(12) United States Patent
Sagara et al.

(10) Patent No.: US 8,333,509 B2
(45) Date of Patent: Dec. 18, 2012

(54) BAG CONTAINER

(75) Inventors: Koichi Sagara, Tokyo (JP); Shigeyuki Kawamata, Tokyo (JP); Yoshinori Inagawa, Tokyo (JP); Takao Kurosawa, Tokyo (JP); Shigeo Kamata, Tokyo (JP)

(73) Assignees: Kao Corporation, Tokyo (JP); Yoshino Kogyosho Co., Ltd., Tokyo (JP)

( * ) Notice: Subject to any disclaimer, the term of this patent is extended or adjusted under 35 U.S.C. 154(b) by 300 days.

(21) Appl. No.: 12/935,440

(22) PCT Filed: May 18, 2009

(86) PCT No.: PCT/JP2009/059143

§ 371 (c)(1),
(2), (4) Date: Sep. 29, 2010

(87) PCT Pub. No.: WO2009/142177

PCT Pub. Date: Nov. 26, 2009

(65) Prior Publication Data

US 2011/0026859 A1 Feb. 3, 2011

(30) Foreign Application Priority Data

May 21, 2008 (JP) ..... 2008-132935

(51) Int. Cl.
*B65D 33/00* (2006.01)
*B65D 30/16* (2006.01)

(52) U.S. Cl. ..... 383/105; 383/104; 383/904; 383/906

(58) Field of Classification Search ..... 383/105, 383/904, 906, 104, 67, 62, 41, 200, 207
See application file for complete search history.

(56) References Cited

U.S. PATENT DOCUMENTS

D608,643 S * 1/2010 Sagara et al. ..... D9/516
2006/0140515 A1 6/2006 Inaba et al.

FOREIGN PATENT DOCUMENTS

JP 49 12170 2/1974

(Continued)

OTHER PUBLICATIONS

International Search Report issued Jun. 9, 2009 in PCT/JP09/59143 filed May 18, 2009. Extended European Search Report issued May 31, 2011, in Patent Application No. 09750539.0.
U.S. Appl. No. 12/935,441, filed Sep. 29, 2010, Sagara, et al.

*Primary Examiner* — Jes F Pascua
(74) *Attorney, Agent, or Firm* — Oblon, Spivak, McClelland, Maier & Neustadt, L.L.P.

(57) ABSTRACT

A bag container including a synthetic-resin container body shaped by using a mold and including a spout-forming portion and a filling inlet portion that project outward therefrom. Contents are first filled through the filling inlet portion, and then fusion-bond sealing is applied to the filling inlet portion. The filling inlet portion has, at its sealing base portion, a square cross-sectional shape. A tip-end-side cross-section-changing portion and a cylindrical portion are provided on the tip-end side with respect to the sealing base portion. Four triangular panels each isosceles triangle shaped are connectedly provided on the side of the container body with respect to the sealing base portion along a circumferential direction of the filling inlet portion, a base of each isosceles triangle formed of one of sides of the square cross-sectional shape. When the fusion-bond sealing is to be applied to the filling inlet portion, a region on the tip-end side with respect to the sealing base portion is folded flat while positioning a pair of opposing corners on opposite edges of the filling inlet portion.

16 Claims, 4 Drawing Sheets

FOREIGN PATENT DOCUMENTS

| | | | | |
|---|---|---|---|---|
| JP | 11 130073 | | | 5/1999 |
| JP | 11-130112 | | | 5/1999 |
| JP | 2002-193232 | | | 7/2002 |
| JP | 3371215 | | | 1/2003 |
| JP | 2004-175378 | | | 6/2004 |
| JP | 2005289383 | A | * | 10/2005 |
| JP | 2008273542 | A | * | 11/2008 |
| WO | WO 96/14254 | | | 5/1996 |

* cited by examiner

BAG CONTAINER

TECHNICAL FIELD

The present invention relates to a bag container made by shaping its synthetic-resin container body by using a mold.

BACKGROUND ART

Pouches made by bonding synthetic-resin sheets together are generally known as bag containers for refilling contents such as liquid agents. (See, for example, JP-A-2001-213448.) The content liquid of the pouch is filled through, for example, the upper-side section, which serves as a filling inlet portion, to place inside and then the upper-side section of the pouch is sealed through fusion bonding. In this way, the pouch is manufactured as a pouch-enclosed refill product, enclosing its content liquid.

Meanwhile, pouches made by bonding synthetic-resin sheets together have such drawbacks as complicated manufacturing processes involved in bonding, impaired outer appearance caused by wrinkles being formed when the body expands due to filling the contents, and low impact-resistance strength at the bonded sections. In order to overcome these drawbacks, various bag containers have been developed that are made by shaping their container bodies made of synthetic resin using a mold. (See, for example, JP-A-2004-175378, JP-A-2002-193232 and JP-A-11-130112.) Such a bag container made through shaping using a mold is also designed so that its contents are enclosed therein by first filling the contents through a filling inlet portion, which is provided projecting outward from the circumferential surface of the container body, to place the contents inside and then applying fusion-bond sealing to the filling inlet portion.

DISCLOSURE OF THE INVENTION

The present invention is a bag container having a container body shaped by using a mold. The container body is made of synthetic resin and has a spout-forming portion and a filling inlet portion that project outward from a circumferential surface of the container body. Contents of the bag container are enclosed therein by first filling the contents through the filling inlet portion to place the contents inside and then applying fusion-bond sealing to the filling inlet portion. Before the filling inlet portion undergoes fusion-bond sealing, the filling inlet portion has, at a sealing base portion thereof that constitutes a boundary of a region for applying the fusion-bond sealing, a polygonal cross-sectional shape having an even number of corners. A tip-end-side cross-section-changing portion is provided on a tip-end side with respect to the sealing base portion, the tip-end-side cross-section-changing portion changing the cross-sectional shape of the filling inlet portion in such a design as to connect the sealing base portion to a cylindrical portion. A plurality of flat triangular panels each having a shape of an isosceles triangle are provided on the container-body side with respect to the sealing base portion, the triangular panels being provided in a connected manner along a circumferential direction of the filling inlet portion. A base of each isosceles triangle is formed of one of the sides of the polygonal cross-sectional shape having the even number of corners. Legs of that isosceles triangle are respectively formed of ridgelines located on both sides of the base, the ridgelines respectively starting from opposite ends of the base. When the fusion-bond sealing is to be applied to the filling inlet portion, a pair of opposing corners of the polygonal cross-sectional shape, which has the even number of corners, of the sealing base portion before undergoing the fusion-bond sealing is positioned respectively on opposite edges of the filling inlet portion after having undergone the fusion-bond sealing by folding up a region on the tip-end side with respect to the sealing base portion in such a manner as to squash that region.

BRIEF DESCRIPTION OF THE DRAWINGS

FIG. 1(*b*) is a side view of the bag container according to a preferred embodiment of the present invention, as viewed from the left-hand side of FIG. 1(*a*).

FIG. 2(*b*) is a cross-sectional view taken along B-B of FIG. 1(*a*) for describing a cross-sectional shape of the filling inlet portion.

FIG. 2(*c*) is a cross-sectional view taken along C-C of FIG. 1(*a*) for describing a cross-sectional shape of the filling inlet portion.

FIG. 2(*d*) is a cross-sectional view taken along D-D of FIG. 1(*a*) for describing a cross-sectional shape of the filling inlet portion.

FIG. 4(*b*) is a partial cross-sectional view for describing a state after the bottom of the container body has been pressed into the body.

DETAILED DESCRIPTION OF THE INVENTION

Figure 1A:
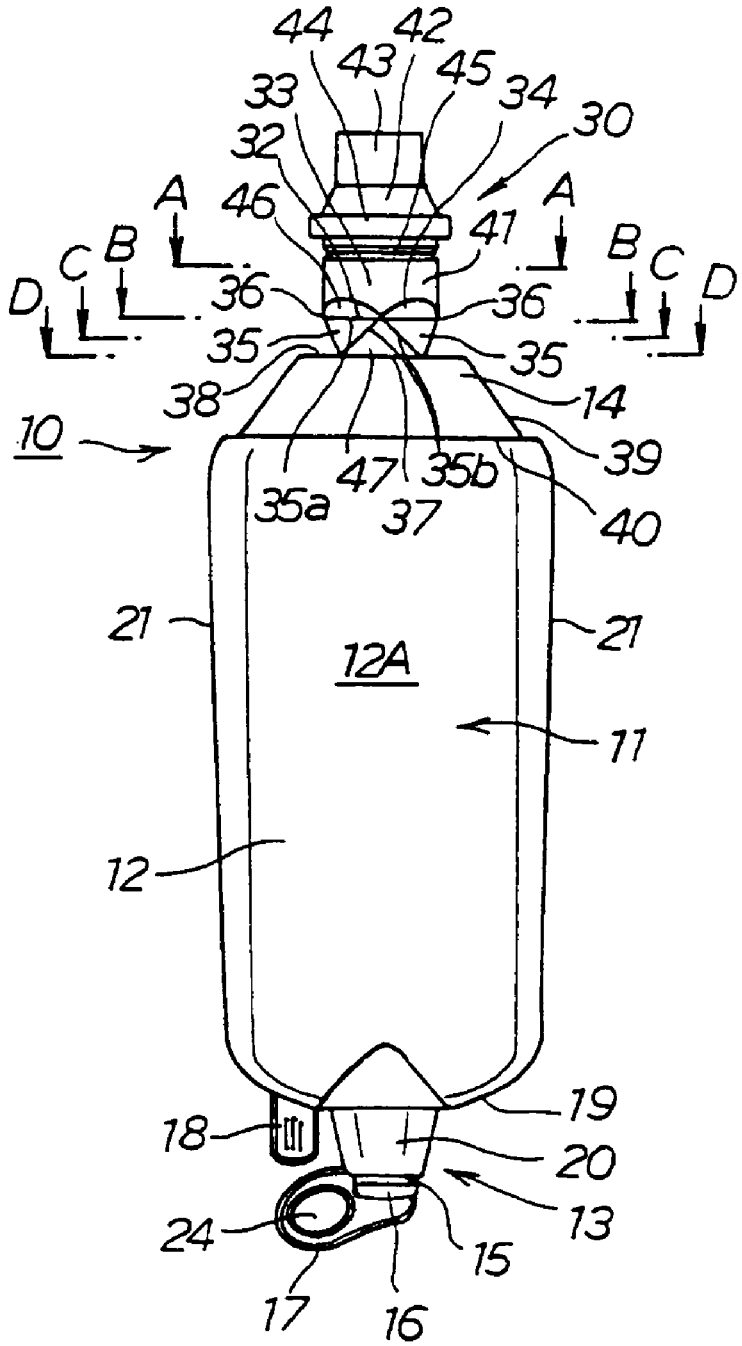
FIG. 1(*a*) is a front view of a bag container according to a preferred embodiment of the present invention.

In the above-described conventional bag container made by shaping its synthetic-resin container body using a mold, the filling inlet portion is formed into a tubular shape having, for example, a circular or oval cross-sectional shape, and is also formed into a three-dimensional shape having considerable rigidity for retaining its shape. Therefore, when fusion-bond sealing is to be applied to the filling inlet portion by sandwiching the portion with a sealing bar etc. after the contents having been filled and placed inside, it is difficult to squash the filling inlet portion into a flat, folded state, which requires a large squashing force. Further, if the squashing force is insufficient, the fusion bonding may become poor at the fusion-bond sealed portion, and the outer appearance of the fusion-bond sealed portion may become impaired due to sagging and/or wrinkles.

The present invention relates to a bag container whose filling inlet portion can be easily squashed into a flat, folded state when fusion-bond sealing is to be applied to the filling inlet portion after the contents have been filled and placed inside, allowing fusion-bond sealing to be applied accurately in a stable state.

The present invention is a bag container having a container body shaped by using a mold. The container body is made of synthetic resin and has a spout-forming portion and a filling inlet portion that project outward from a circumferential surface of the container body. Contents of the bag container are enclosed therein by first filling the contents through the filling inlet portion to place the contents inside and then applying fusion-bond sealing to the filling inlet portion. Before the filling inlet portion undergoes fusion-bond sealing, the filling inlet portion has, at a sealing base portion thereof that constitutes a boundary of a region for applying the fusion-bond sealing, a polygonal cross-sectional shape having an even number of corners. A tip-end-side cross-section-changing portion is provided on a tip-end side with respect to the sealing base portion, the tip-end-side cross-section-changing portion changing the cross-sectional shape of the filling inlet portion in such a design as to connect the sealing base portion to a cylindrical portion. A plurality of flat triangular panels each having a shape of an isosceles triangle are provided on the container-body side with respect to the sealing base portion, the triangular panels being provided in a connected manner along a circumferential direction of the filling inlet portion. A base of each isosceles triangle is formed of one of the sides of the polygonal cross-sectional shape having the even number of corners. Legs of that isosceles triangle are respectively formed of ridgelines located on both sides of the base, the ridgelines respectively starting from opposite ends of the base. When the fusion-bond sealing is to be applied to the filling inlet portion, a pair of opposing corners of the polygonal cross-sectional shape, which has the even number of corners, of the sealing base portion before undergoing the fusion-bond sealing is positioned respectively on opposite edges of the filling inlet portion after having undergone the fusion-bond sealing by folding up a region on the tip-end side with respect to the sealing base portion in such a manner as to squash that region.

Figure 1B:
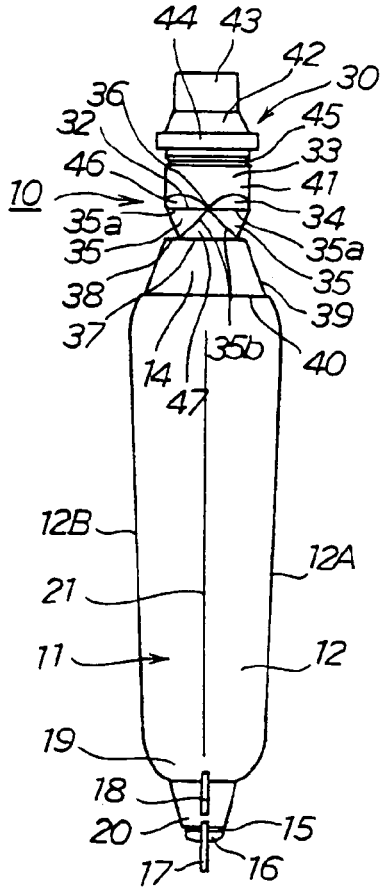
Figure 2A:
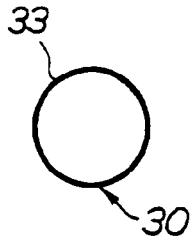
FIG. 2(*a*) is a cross-sectional view taken along A-A of FIG. 1(*a*) for describing a cross-sectional shape of a filling inlet portion.
Figure 2B:
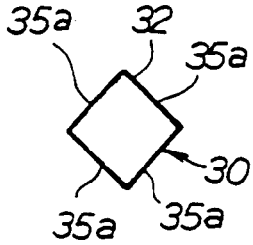
Figure 2C:
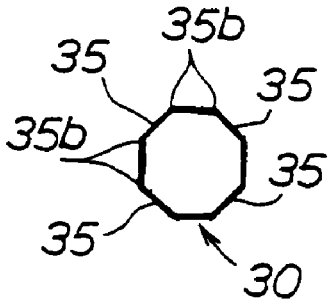
Figure 2D:
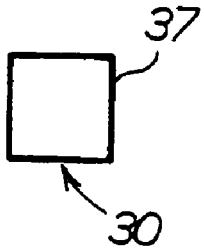

A bag container 10 according to a preferred embodiment of the present invention shown in FIGS. 1(*a*) and 1(*b*) is formed into a hollow three-dimensional shape by employing blow molding, such as direct blow molding or injection blow molding, as the "shaping using a mold". Further, the bag container 10 of the present embodiment is used as a container for enclosing, for example, a liquid agent—particularly, a shampoo, a body wash, a liquid detergent, a cleaning agent, etc.—as its contents, and the liquid agent is filled into and placed inside the bag container 10. The bag container 10 is manufactured into a self-standing refill bag that is, for example, opened upon use for refilling another container with the contents (see FIG. 5). Further, the bag container 10 of the present embodiment has a function of allowing its filling inlet portion 30 to be folded up easily into a flat state after the liquid agent has been filled and placed inside during, for example, the process of manufacturing the self-standing refill bag to thus allow fusion-bond sealing to be applied to the filling inlet portion 30 accurately in a stable state.

Further, the bag container 10 of the present embodiment includes a synthetic-resin container body 11 shaped by using a mold and having a spout-forming portion 13 and a filling inlet portion 30 that project outward from the circumferential surface of the container body 11. The bag container 10 is a pouch-like container so designed that its contents are enclosed therein by first filling the contents through the filling inlet portion 30 to place the contents inside, then folding up a region on the tip-end side with respect to a later-described sealing base portion 32 of the filling inlet portion 30 in such a manner as to squash the region, and then applying fusion-bond sealing to the filling inlet portion 30. As illustrated in FIGS. 2(*a*) to 2(*d*) and FIG. 3, the filling inlet portion 30 has, at its sealing base portion 32 that constitutes a boundary of a region for applying the fusion-bond sealing, a polygonal cross-sectional shape having an even number of corners—preferably a quadrilateral cross-sectional shape, and more preferably a square cross-sectional shape—as viewed from above. Further, a tip-end-side cross-section-changing portion 34 is provided on the tip-end side (the upper-end side of FIG. 1) with respect to the sealing base portion 32. The portion 34 changes the cross-sectional shape of the filling inlet portion in such a design as to connect the sealing base portion to a cylindrical portion 33. Further, a plurality of (four in the present embodiment) flat triangular panels 35 are provided on the side of the container body 11 with respect to the sealing base portion 32 in a connected manner along the circumferential direction of the filling inlet portion 30. Each triangular panel 35 has the shape of an isosceles triangle whose base 35*a* is formed of one of the sides of the square cross-sectional shape and whose legs are respectively formed of ridgelines 35*b* located on both sides of the base and respectively starting from the opposite ends of the base 35*a*. When the fusion-bond sealing is to be applied to the filling inlet portion 30, a pair of opposing corners 36 of the square cross-sectional shape of the sealing base portion 32 before undergoing the fusion-bond sealing is positioned respectively on opposite edges of the filling inlet portion 30 after having undergone the fusion-bond sealing by folding up a region on the tip-end side with respect to the sealing base portion 32 in such a manner as to squash that region (see FIG. 3).

More specifically, the filling inlet portion 30 of the present embodiment before undergoing the fusion-bond sealing includes a sealing base portion 32 that has a polygonal cross-sectional shape having an even number of corners (a square cross-sectional shape), and a cylindrical portion 33 provided on the tip-end side with respect to the sealing base portion 32. Further, a tip-end-side cross-section-changing portion 34 that changes the cross-sectional shape of the filling inlet portion in such a design as to connect the sealing base portion 32 and the cylindrical portion 33 is provided between the sealing base portion 32 and the cylindrical portion 33. Furthermore, a plurality of flat triangular panels 35 are provided in a connected manner along the circumferential direction of the filling inlet portion 30 between the sealing base portion 32 and the container body 11, each triangular panel 35 having the shape of an isosceles triangle whose base 35*a* is formed of one of the sides of the polygonal cross-sectional shape having an even number of corners and whose legs are respectively formed of ridgelines 35*b* located on both sides of the base and respectively starting from the opposite ends of the base 35*a*.

Note that, as described above, the "sealing base portion 32" refers to a boundary of a region for applying the fusion-bond sealing in the filling inlet portion 30. Accordingly, the fusion-bond sealing will be applied in an area from the sealing base portion 32 up to an engagement groove 45 on the tip-end side including the sealing base portion 32 (the upper-end side of FIG. 1(*a*)). This is because employing this area will allow the filling inlet portion 30 to be easily squashed into a flat, folded state, allowing fusion-bond sealing to be applied accurately in a stable state.

Further, in the present embodiment, the spout-forming portion 13 is provided projecting outward from a shoulder 19 of the container body 11, and the filling inlet portion 30 is provided projecting outward from the bottom 14 of the container body 11.

Furthermore, in the present embodiment, a portion of the filling inlet portion 30 on the side of the container body 11 with respect to the sealing base portion 32 is connected to a later-described seat portion 38 provided on the bottom 14 of the container body 11 via a square cross-sectional-shaped portion (a polygonal cross-sectional-shaped portion that has an even number of corners) 37 that is formed by connecting each vertex of the four triangular panels 35.

In the present embodiment, the synthetic-resin container body 11 is formed, preferably by blow molding, into a hollow three-dimensional shape that includes a body 12 having the spout-forming portion 13 on the shoulder 19, and the bottom 14 having the filling inlet portion 30. Various known molding techniques, such as direct blow molding or injection blow molding, may be adopted for blow molding.

Further, it is possible to adopt, as the synthetic-resin material for forming the container body 11, a single layer of, for example, a soft synthetic-resin material including a polyolefin-based resin such as LDPE (low-density polyethylene), L-LDPE (linear low-density polyethylene) and OPP (oriented polypropylene), or a polyester-based resin such as PET (polyethylene terephthalate). It is also possible to adopt laminated resins obtained by laminating the above synthetic resin(s) and other synthetic resin(s). For example, it is possible to adopt a laminated resin employing LDPE or L-LDPE for its inner layer and HDPE (high-density polyethylene) for its outer layer. Further, it is also possible to adopt a resin obtained by laminating EVOH resin (ethylene-vinyl alcohol copolymer resin), EVA resin (ethylene-vinyl acetate copolymer resin), nylon resin, etc., or a blended resin obtained by blending resins, such as EVA, EVOH, and nylon, with another resin such as PE (polyethylene).

According to the present embodiment, blow molding using the above-described synthetic-resin material(s) allows the side edges of the front portion 12A and the side edges of the back portion 12B to be contiguous via a parting lines 21 of the mold sandwiched in between, in the cross section traversing the body 12. This provides the body 12 of the container body 11 which has a hollow cross-sectional shape having either an oval shape or a rectangular shape with rounded corners and also has a flat shape that is broad when viewed from the front or the rear and narrow when viewed from the side. Further, through the blow molding, the container body 11 is formed so that the edge of the body 12 on the side of the bottom 14 is integrally molded with the bottom 14 via a bordering stepped portion 40. Further, the container body 11 is formed into such a shape that a portion of the body 12 on the side of the spout-forming portion 13 is gradually tapered, forming the shoulder 19, and the spout-forming portion 13 projects outward from the central portion of the shoulder 19 as a mouth/neck portion.

The body 12 and the bottom 14 of the synthetic-resin container body 11 are preferably molded to a thickness of 100 μm or above in order to ensure a stable self-standing ability when the contents are filled and placed inside and the bag container is manufactured into a self-standing bag. Further, it is preferable to mold the body 12 and the bottom 14 to a thickness of, for example, 700 μm or below, and more preferably, a thickness of 500 μm or below, in order to provide suitable flexibility, allow squashing, folding, and/or bending, and allow the container body to be substantially flattened.

In the present embodiment, the spout-forming portion 13 projecting outward from the central portion of the shoulder 19 of the body 12 includes a base portion 20, and a to-be-torn portion 16 that is provided in a connected manner to the tip end of the base portion 20 via an easy-to-tear portion 15 and that closes off the upper-end opening (the spout) of the base portion 20. The base portion 20 is shaped generally like a hollow truncated cone that gradually tapers toward the tip end.

Further, in the present embodiment, the easy-to-tear portion 15 that has, for example, a narrow groove-like depression formed annularly around the outer circumferential surface of the spout-forming portion 13 sections the spout-forming portion 13 into the base portion 20 below the easy-to-tear portion 15 and the to-be-torn portion 16 thereabove. After the bag container 10 has been manufactured into a self-standing bag, the self-standing bag can be opened from its sealed state by tearing off the to-be-torn portion 16, which is more toward the tip-end area than the easy-to-tear portion 15, from the base portion 20 to form a spout.

The to-be-torn portion 16, which is provided in a connected manner to the upper end of the base portion 20 via the easy-to-tear portion 15, has a disk-like shape and closes off the spout by being arranged so as to cover the upper-end opening (the spout) of the base portion 20 and being integrally molded with the base portion 20 and the easy-to-tear portion 15. The easy-to-tear portion 15 has an opening tab 17 that has an engagement hole 24 and that is provided extending in the diametral direction along the parting line 21 of the mold for molding (the direction of the side edge of the front portion 12A or the back portion 12B), the opening tab 17 being provided integrally on the upper surface of the disk-like to-be-torn portion 16. Herein, the "plane along the parting line 21" is a virtual plane including the parting line 21.

Further, in the present embodiment, the shoulder 19 of the body 12 has a catch tab 18 provided adjacent to the spout-forming portion 13 on the side towards which the opening tab 17 projects, the catch tab 18 projecting outward from the shoulder 19 while being spaced apart from the spout-forming portion 13.

Figure 4A:
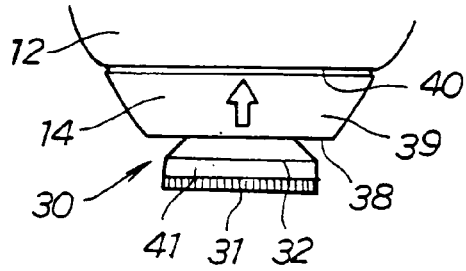
FIG. 4(*a*) is a partial front view for describing a state before the bottom of a container body is pressed into the body.
Figure 4B:
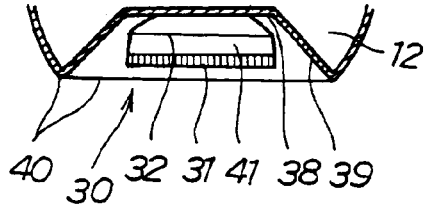
Figure 5:
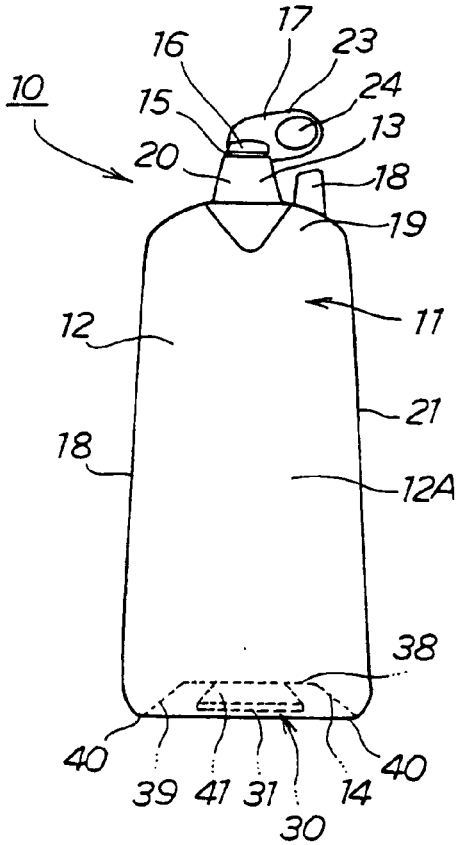
FIG. 5 is a front view of a self-standing bag made by using the bag container according to a preferred embodiment of the present invention.

In the present embodiment, the bottom 14 of the container body 11 has a narrowing region 39 and a seat portion 38. A cross-sectional area of the narrowing region 39 is gradually reduced from the bordering stepped portion 40, which borders the body 12, toward the tip-end side. The seat portion 38 has a flat, substantially-oval planar shape and covering the tip-end portion of the narrowing region 39. After the contents have been filled into and placed inside the container body 11, fusion-bond sealing has been applied to the filling inlet portion 30 to form the fusion-bond sealed portion 31, and a portion on the tip-end side with respect to the fusion-bond sealed portion 31 has been cut away, the bottom 14 is pushed in and depressed into the body 12 so as to invert the narrowing region 39, thereby forming a placing section by means of the bordering stepped portion 40 bordering the body 12, as illustrated in FIGS. 4(*a*) and 4(*b*). Settling the bottom via the placing section will allow the bag container 10 enclosing its contents to be placed in a stable self-standing state (upright state) on a plane where the container should be placed, as illustrated in FIG. 5.

In the present embodiment, the filling inlet portion 30 provided projecting outward from the seat portion 38 of the bottom 14 is a hollow tubular portion having an inner diameter of, for example, around 20 to 30 mm, and has a filling-inlet sealing portion 41 located on the side of the container body 11 and a positioning-and-insertion portion 42 located on the tip-end side, as illustrated in FIGS. 1(*a*) and 1(*b*).

The positioning-and-insertion portion 42 is a portion having a function for accurately positioning the filling inlet portion 30 with respect to a filling machine, for example, at the time of filling and placing a liquid agent inside the bag container 10 during the process of manufacturing the self-standing bag so that a filling nozzle of the filling machine can be inserted accurately into a nozzle insertion-fitting portion 43. The positioning-and-insertion portion 42 includes, for example, an engagement jaw 44 and an engagement groove 45 for engagement with a positioning-and-engagement stage of the filling machine. Note that as regards the nozzle insertion-fitting portion 43 of the positioning-and-insertion portion 42, in order to prevent impurities etc. from entering the bag container 10 before the liquid agent is filled and placed inside, it is preferable, for example, to carry/transport the molded bag container 10 with the tip-end opening of the nozzle insertion-fitting portion 43 sealed until the liquid agent is to be filled, and to open the nozzle insertion-fitting portion 43 immediately before filling the liquid agent by cutting the sealed portion.

The filling-inlet sealing portion 41 of the filling inlet portion 30 is a portion that undergoes fusion-bond sealing after the liquid agent has been filled into and placed inside the bag container 10. As described above, the filling-inlet sealing portion 41 has a square cross-sectional shape at the sealing base portion 32 which constitutes a boundary of a region for applying the fusion-bond sealing. Further, the tip-end-side cross-section-changing portion 34 and the cylindrical portion 33 are provided on the tip-end side with respect to the sealing base portion 32. Further, four flat triangular panels 35 are provided on the side of the container body 11 with respect to the sealing base portion 32 in a connected manner along the circumferential direction of the filling inlet portion 30. Each triangular panel 35 has the shape of an isosceles triangle whose base 35*a* is formed of one of the sides of the square cross-sectional shape of the sealing base portion 32 and whose legs are respectively formed of ridgelines 35*b* located on both sides of the base and respectively starting from the opposite ends of the base 35*a*. Further, the filling-inlet sealing portion 41 is connected to the seat portion 38 provided on the bottom 14 of the container body 11 via a square cross-sectional-shaped portion 37 that is formed by connecting each vertex of the four triangular panels 35.

Accordingly, when viewed from above, the filling-inlet sealing portion 41 has a circular cross-sectional shape at the cylindrical portion 33, and a square cross-sectional shape at the sealing base portion 32, as illustrated in FIGS. 2(*a*) to 2(*d*). Further, the filling-inlet sealing portion 41 has an octagonal cross-sectional shape at a portion between the sealing base portion 32 and the seat portion 38, and has, at the portion connected to the seat portion 38, a square cross-sectional shape whose diagonal direction is shifted by 45 degrees from that of the cross-sectional shape of the sealing base portion 32.

Further, in the present embodiment, arc-shaped panels 46 are formed in the tip-end-side cross-section-changing portion 34, and these arc-shaped panels 46 accommodate the change in cross-sectional shape between the sealing base portion 32 and the cylindrical portion 33. Furthermore, the present embodiment has, between adjacent triangular panels 35 which are arranged on the side of the container body 11 with respect to the sealing base portion 32, intermediate triangular panels 47 each having the shape of an isosceles triangle whose base is formed of one of the sides of the square cross-sectional-shaped portion 37 at the connection with the seat portion 38 and whose legs are respectively formed of ridgelines 35*b* located on both sides of the base and respectively starting from the opposite ends of the base. Further, in the present embodiment, the tip-end-side cross-section-changing portion 34 and the cylindrical portion 33 have the same perimeter as the sealing base portion 32 in a cross section of these portions.

More specifically, in the present embodiment, one arc-shaped panel 46 and one triangular panel 35 are combined to form a substantially sector-shaped panel, and the tubular filling-inlet sealing portion 41 is made up by combining a plurality of the substantially sector-shaped panels with the intermediate triangular panels 47 and further including the cylindrical portion 33.

The bag container 10 of the present embodiment having the above-described structure allows the filling inlet portion 30 to be squashed easily into a flat, folded state, for example, when fusion-bond sealing is to be applied to the filling inlet portion 30 after the contents having been filled to place inside, during the process of manufacturing the self-standing bag, thus allowing the fusion-bond sealed portion 31 to be formed accurately in a stable state.

Figure 3:
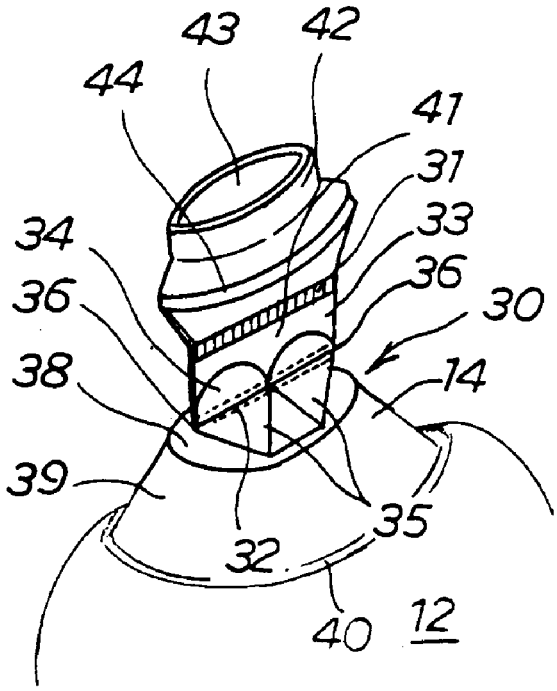
FIG. 3 is a partial perspective for describing a state in which a fusion-bond sealed portion has been formed by applying fusion-bond sealing to the filling inlet portion.

More specifically, according to the present embodiment, the filling inlet portion 30 has a square cross-sectional shape at its sealing base portion 32, and the cylindrical portion 33 is provided on the tip-end side with respect to the sealing base portion 32 with the tip-end-side cross-section-changing portion 34 disposed therebetween. Further, four flat triangular panels 35 are provided in a connected manner along the circumferential direction on the side of the container body 11 with respect to the sealing base portion 32, each triangular panel 35 having the shape of an isosceles triangle whose base 35*a* is formed of one of the sides of the square cross-sectional shape. Accordingly, when the fusion-bond sealing is to be applied to the filling inlet portion 30, a pair of opposing corners 36 of the square cross-sectional shape of the sealing base portion 32 before undergoing the fusion-bond sealing will be positioned respectively on opposite edges of the filling inlet portion 30 after having undergone the fusion-bond sealing by folding up a region on the tip-end side with respect to the sealing base portion 32 in such a manner as to squash that region, as illustrated in FIG. 3. Thus, the region for applying the fusion-bond sealing, which is on the tip-end side with respect to the sealing base portion 32, can be folded up easily into a flat state. This will allow a sealing bar, for example, to easily sandwich the region for applying the fusion-bond sealing, thus allowing fusion-bond sealing to be applied to the filling inlet portion 30 accurately in a stable state without giving rise to poor fusion bonding, sagging, and/or wrinkles.

Further, as described above, in the bag container 10 of the present embodiment, the filling inlet portion 30 before undergoing the fusion-bond sealing has a polygonal cross-sectional shape having an even number of corners at its sealing base portion 32 that constitutes a boundary of a region for applying the fusion-bond sealing. Further, a tip-end-side cross-section-changing portion 34 that changes the cross-sectional shape of the filling inlet portion in such a design as to connect to the cylindrical portion 33 is provided on the tip-end side with respect to the sealing base portion 32, and a plurality of flat triangular panels 47 are provided in a connected manner along the circumferential direction of the filling inlet portion 30 on the side of the container body 11 with respect to the sealing base portion 32, each triangular panel having the shape of an isosceles triangle whose base 35*a* is formed of one of the sides of the polygonal cross-sectional shape having an even number of corners and whose legs are respectively formed of ridgelines 35*b* located on both sides of the base and respectively starting from the opposite ends of the base 35*a*. Thus, even in cases where the distance from the sealing base portion 32 to the seat portion 38 is short (i.e., the distance is shorter than the inner diameter of the filling inlet portion 30), the filling inlet portion 30 can be squashed easily into a flat, folded state when fusion-bond sealing is to be applied to the filling inlet portion 30 after the contents have been filled and placed inside, allowing fusion-bond sealing to be applied accurately in a stable state. For example, assuming that the inner diameter of the filling inlet portion 30 is 1, fusion-bond sealing can be applied accurately in a stable state even when the distance from the sealing base portion 32 to the seat portion 38 is between 1 to 0.1. In practice, fusion-bond sealing can be applied accurately in a stable state if the distance from the sealing base portion 32 to the seat portion 38 is from 1 to 0.25. If a plurality of triangular panels 35 are not provided in a connected manner along the circumferential direction of the filling inlet portion 30, then, in cases where the distance from the sealing base portion 32 to the seat portion 38 is short, a counter-force produced when bringing the filling inlet portion 30 into its flat, folded state may make it difficult to squash the filling inlet portion 30 upon applying fusion-bond sealing thereto.

Note that various modifications may be made to the present invention without limitation to the foregoing embodiment. For example, the sealing base portion does not necessarily have to have a square cross-sectional shape, and it may have other polygonal cross-sectional shapes having an even number of corners, such as a hexagonal or octagonal shape, whose pair of opposing corners can be positioned on opposite edges of the filling inlet portion when it is folded up. Further, it is not always necessary to provide the spout-forming portion on the shoulder of the container body and the filling inlet portion on the bottom of the container body, and these components may be provided protruding outward from other portions. Furthermore, the bottom of the container body does not necessarily have to have the structure of being inverted and depressed into the body, and the bag container may be used as various other types of bag-like containers—other than self-standing bags—for enclosing contents.

INDUSTRIAL APPLICABILITY

The bag container according to the present invention allows the filling inlet portion to be squashed easily into a flat, folded state when fusion-bond sealing is to be applied to the filling inlet portion after the contents having been filled and placed inside, thus allowing fusion-bond sealing to be applied accurately in a stable state.

The invention claimed is:

1. A bag container comprising a container body shaped by using a mold, the container body being made of synthetic resin and having a spout-forming portion and a filling inlet portion that project outward from a circumferential surface of the container body, contents of the bag container being enclosed therein by first filling the contents through the filling inlet portion to place the contents inside and then applying fusion-bond sealing to the filling inlet portion, wherein:

before the filling inlet portion undergoes fusion-bond sealing, the filling inlet portion has, at a sealing base portion thereof that constitutes a boundary of a region for applying the fusion-bond sealing, a polygonal cross-sectional shape having an even number of corners, a tip-end-side cross-section-changing portion is provided on a tip-end side with respect to the sealing base portion, the tip-end-side cross-section-changing portion changing the cross-sectional shape of the filling inlet portion in such a design as to connect the sealing base portion to a cylindrical portion, and a plurality of flat triangular panels each having a shape of an isosceles triangle are provided on the container-body side with respect to the sealing base portion, the triangular panels being provided in a connected manner along a circumferential direction of the filling inlet portion, a base of each isosceles triangle being formed of one of the sides of the polygonal cross-sectional shape having the even number of corners and legs of that isosceles triangle being respectively formed of ridgelines located on both sides of the base, the ridgelines respectively starting from opposite ends of the base; and when the fusion-bond sealing is to be applied to the filling inlet portion, a pair of opposing corners of the polygonal cross-sectional shape, which has the even number of corners, of the sealing base portion before undergoing the fusion-bond sealing is positioned respectively on opposite edges of the filling inlet portion after having undergone the fusion-bond sealing by folding up a region on the tip-end side with respect to the sealing base portion in such a manner as to squash that region.

2. The bag container according to claim 1, wherein the sealing base portion has a square cross-sectional shape.

3. The bag container according to claim 1, wherein a portion of the filling inlet portion on the container-body side with respect to the sealing base portion is connected to a seat portion provided on a bottom of the container body via a polygonal cross-sectional-shaped portion that has an even number of corners and that is formed by connecting each vertex of the plurality of triangular panels.

4. The bag container according to claim 1, wherein the tip-end-side cross-section-changing portion and the cylindrical portion have the same perimeter as the sealing base portion.

5. The bag container according to claim 1, wherein the spout-forming portion is provided projecting outward from a shoulder of the container body, and the filling inlet portion is provided projecting outward from the bottom of the container body.

6. The bag container according to claim 2, wherein a portion of the filling inlet portion on the container-body side with respect to the sealing base portion is connected to a seat portion provided on a bottom of the container body via a polygonal cross-sectional-shaped portion that has an even number of corners and that is formed by connecting each vertex of the plurality of triangular panels.

7. The bag container according to claim 2, wherein the tip-end-side cross-section-changing portion and the cylindrical portion have the same perimeter as the sealing base portion.

8. The bag container according to claim 3, wherein the tip-end-side cross-section-changing portion and the cylindrical portion have the same perimeter as the sealing base portion.

9. The bag container according to claim 6, wherein the tip-end-side cross-section-changing portion and the cylindrical portion have the same perimeter as the sealing base portion.

10. The bag container according to claim 2, wherein the spout-forming portion is provided projecting outward from a shoulder of the container body, and the filling inlet portion is provided projecting outward from the bottom of the container body.

11. The bag container according to claim 3, wherein the spout-forming portion is provided projecting outward from a shoulder of the container body, and the filling inlet portion is provided projecting outward from the bottom of the container body.

12. The bag container according to claim 4, wherein the spout-forming portion is provided projecting outward from a shoulder of the container body, and the filling inlet portion is provided projecting outward from the bottom of the container body.

13. The bag container according to claim 6, wherein the spout-forming portion is provided projecting outward from a shoulder of the container body, and the filling inlet portion is provided projecting outward from the bottom of the container body.

14. The bag container according to claim 7, wherein the spout-forming portion is provided projecting outward from a shoulder of the container body, and the filling inlet portion is provided projecting outward from the bottom of the container body.

15. The bag container according to claim 8, wherein the spout-forming portion is provided projecting outward from a shoulder of the container body, and the filling inlet portion is provided projecting outward from the bottom of the container body.

16. The bag container according to claim 9, wherein the spout-forming portion is provided projecting outward from a shoulder of the container body, and the filling inlet portion is provided projecting outward from the bottom of the container body.

* * * * *